US008965671B2

(12) United States Patent
Choksi et al.

(10) Patent No.: US 8,965,671 B2
(45) Date of Patent: Feb. 24, 2015

(54) AIRCRAFT TAXIING SYSTEM

(71) Applicant: Honeywell International Inc., Morristown, NJ (US)

(72) Inventors: Hardik Choksi, Karanataka (IN); Rafeek Sainudeen, Karanataka (IN); Nagaraj Sham, Karanataka (IN)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/844,804

(22) Filed: Mar. 16, 2013

(65) Prior Publication Data

US 2014/0278037 A1 Sep. 18, 2014

(51) Int. Cl.
*G08G 5/06* (2006.01)

(52) U.S. Cl.
CPC ..... *G08G 5/065* (2013.01)
USPC ..... 701/120

(58) Field of Classification Search
None
See application file for complete search history.

(56) References Cited

U.S. PATENT DOCUMENTS 7,050,909 B2 * 5/2006 Nichols et al. ..... 701/301
7,343,229 B1 * 3/2008 Wilson ..... 701/15
2007/0282491 A1 12/2007 Cox et al.
2008/0306691 A1 * 12/2008 Louis et al. ..... 701/301
2009/0018713 A1 * 1/2009 Coulmeau et al. ..... 701/3
2009/0115637 A1 * 5/2009 Naimer et al. ..... 340/979
2009/0261197 A1 * 10/2009 Cox et al. ..... 244/50
2010/0030404 A1 * 2/2010 Berard ..... 701/14
2010/0324807 A1 * 12/2010 Doose et al. ..... 701/120
2011/0127366 A1 * 6/2011 Becker ..... 244/50
2011/0199239 A1 * 8/2011 Lutz et al. ..... 340/995.14
2012/0138734 A1 6/2012 Hissong
2013/0297102 A1 * 11/2013 Hughes et al. ..... 701/3

* cited by examiner

*Primary Examiner* — John R Olszewski
*Assistant Examiner* — Jess Whittington
(74) *Attorney, Agent, or Firm* — Shimokaji & Assoc., P.C.

(57) ABSTRACT

An aircraft taxiing system is provided, comprising a flight control system, an electric taxi system having controls, a flight management system (FMS), at least one data input source coupled to the FMS, and a traffic collision avoidance system (TCAS). The FMS is programmed with instructions to calculate guidance speed and heading commands, augment the guidance commands to avoid runway incursions, and transmit the guidance commands to the flight control system. The TCAS is programmed with instructions to receive Automatic Dependent Surveillance-Broadcast (ADS-B) data from ground traffic, generate collision avoidance alerts; and transmit the collision avoidance alerts to the flight control system. The flight control system is programmed with instructions to receive guidance commands from the FMS, receive the traffic collision avoidance alerts from the TCAS, and compute the steering commands, and transmit the commands to the electric taxi system to taxi the aircraft along a calculated taxi route.

16 Claims, 3 Drawing Sheets

AIRCRAFT TAXIING SYSTEM

BACKGROUND OF THE INVENTION

The present invention generally relates to aircraft taxiing and, in particular, to a taxiing system to facilitate the safe and efficient movement of aircraft on the ground.

Taxiing is the movement of an aircraft on the ground from the gate to the runway prior to takeoff and from the runway to the gate after landing. The taxi-out phase of an aircraft accounts for a significant percentage of the total fuel burned from the origination gate to the destination gate. In addition, the more turns or stops an aircraft makes during taxiing, the more fuel is burned.

Runway incursions account for a large number of airport accidents. During taxi-out, the pilot may be distracted by pre-takeoff activities and may not be fully focused on guiding the aircraft to the runway. Weather-related issues, such as excessive speed on snow or ice or in poor visibility, may be a factor in accidents, as well. Other accidents may be the result of collisions with other taxiing aircraft or ground vehicles. In addition, the pilot relies on air traffic control to know the status and location of other aircraft, ground vehicles, and other obstacles on and near runways and taxiways.

The Federal Aviation Administration (FAA) has addressed the issue of runway incursion in such documents as the Safety Alert for Operators (SAFO) 11004, dated Jun. 10, 2011. As can be seen, however, the implementation of more extensive solutions may further improve aircraft taxiing safety.

SUMMARY OF THE INVENTION

In one aspect of the present invention, an aircraft taxiing system is provided, comprising: a flight control system; an electric taxi control system having controls coupled to the flight control system; a flight management system (FMS) coupled to the flight control system; at least one data input source coupled to the FMS; wherein the FMS is programmed with instructions that, when executed by a first processor: receive runway advisories from a Runway Awareness and Advisory System (RASS); receive taxi route data, aircraft position data, and an airport map data from the at least one data input source; couple the electric taxi system with the flight control system; in response to the taxi route data, calculate guidance speed and heading commands; in response to the runway advisories, augment the guidance speed and heading commands to avoid runway incursions; and transmit the speed and heading guidance commands to the flight control system. The aircraft taxiing system further comprises a traffic collision avoidance system (TCAS) coupled to the flight control system; wherein the TCAS is programmed with instructions that, when executed by a second processor: receive Automatic Dependent Surveillance-Broadcast (ADS-B) data from ground traffic including from taxiing aircraft and ground vehicles; generate collision avoidance alerts in response to the ADS-B data; and transmit the collision avoidance alerts to the flight control system; wherein the flight control system is programmed with instructions that, when executed by a third processor: receive guidance commands from the FMS; receive the traffic collision avoidance alerts from the TCAS; and in response to the guidance commands and collision avoidance alerts, compute the steering commands and transmit the commands to an electric taxi system if available in the aircraft or, if the electric taxi system is not available in the aircraft, to at least one of a nose wheel steering subsystem, an auto-throttle subsystem, and a brake control subsystem to taxi the aircraft along a calculated taxi route.

In a second aspect of the present invention, a flight management system for an aircraft is provided, comprising: a first interface coupled to receive airport map data, runway advisories, air traffic control (ATC) cleared taxi route and aircraft position data from one or more of data sources; a second interface for receiving crew input; a third interface coupled to transmit guidance commands to a flight control system; a fourth interface coupled to transmit a desired ground path to a display subsystem; wherein the FMS is programmed with instructions for receiving air traffic control (ATC) cleared taxi route, GPS/Inertial/Radio Navigation data, airport map data, and runway advisories from at least one data source; computing the desired ground path along the taxi route in response to the ATC cleared taxi route; calculating speed and heading guidance commands along the cleared taxi route making use of the aircraft position data; augmenting the commands for runway incursion avoidance in response to the runway advisories; transmitting the guidance commands to the flight control system; and transmitting the cleared taxi route along with the current aircraft position to an aircraft display system.

In a third aspect of the present invention, a method of taxiing an aircraft at an airport is provided, comprising: receiving runway advisories from a Runway Awareness and Advisory System (RASS); receiving GPS/Inertial/Radio Navigation and air traffic control (ATC) cleared taxi route from at least one data input source; receiving traffic collision alerts from a traffic collision avoidance system (TCAS); calculating steering commands in response to the taxi route data, the runway advisories, and the collision avoidance alerts; if the aircraft is equipped with an electric taxi system: activating the electric taxi system; and transmitting the steering commands to the electric taxi system to safely taxi the aircraft along the taxi route avoiding collisions and incursions; and if the aircraft is not equipped with an electric taxi system: transmitting the steering commands to one or more of an auto-throttle subsystem, a nose wheel steering sub system, and a brake control subsystem to safely taxi the aircraft along the taxi route avoiding collisions and incursions.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide an aircraft taxiing system that may improve both ground safety and fuel efficiency. An aircraft's flight control system may be coupled to an electric taxi system or a combination of the auto throttle, nose wheel steering and braking systems and information received from air traffic control and other sources may allow the aircraft to automatically taxi from gate to runway and from runway to gate in a manner that reduces stops and starts and reduces fuel consumption.

Figure 1:
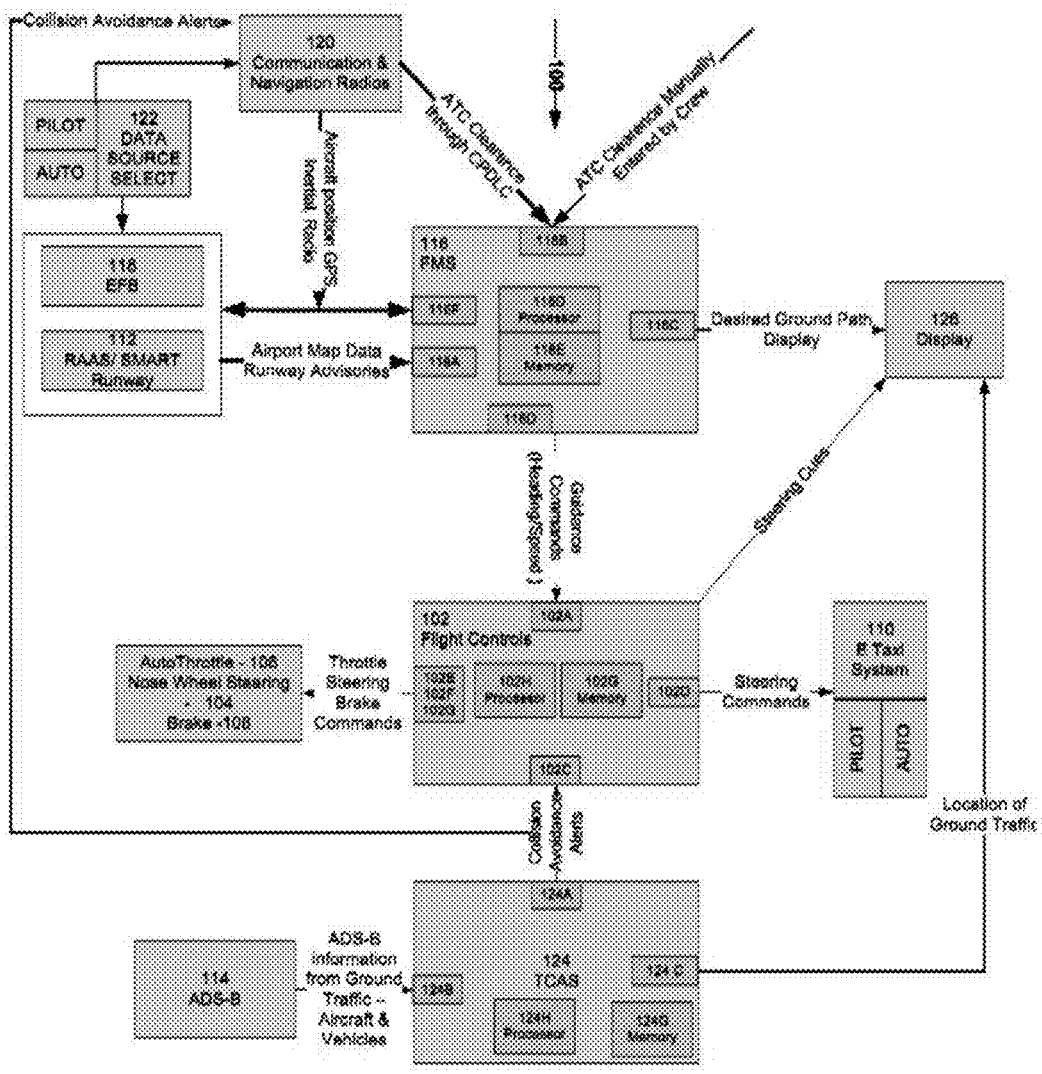
FIG. 1 is block diagram of an embodiment of an aircraft taxiing system of the present invention.

FIG. 1 is a block diagram of an embodiment of a taxiing system 100 that may be installed in an aircraft. The system 100 may incorporate a flight control system 102 which may transmit commands through interfaces, 102E, 102F and 102G to such aircraft subsystems as a nose wheel steering subsystem 104, an auto-throttle subsystem 106, and a brake control subsystem 108 to cause the aircraft to move in accordance with the commands. The flight control system 102 may also include a processor 102H which may be configured to execute program instructions stored in a memory 102G.

The aircraft may be equipped with an electric taxiing system 110 whose controls may be coupled through an interface 102D to the flight control system 102. The flight control system 102 may transmit steering commands through interface 102D to the electric taxiing system 110. The electric taxiing system 110 may include electric motors in the aircraft's wheels that are powered by an auxiliary power unit (APU) generator. Use of electric taxiing allows the aircraft to taxi without using the main engines, thereby saving fuel. A pilot may manually activate and deactivate the coupling of the electric taxi control system to the flight control system 102 to provide automatic taxi. 110. Alternatively, the pilot may choose an automatic mode in which the decision to activate and deactivate the coupling of the electric taxi control system to the flight control system to provide automatic taxi 110 is made automatically by the flight control system 102 based upon such parameters as air speed and weight on the wheels. Once coupled to the flight control system, the electric taxi system may steer the aircraft in accordance with the commands from the flight control system.

A flight management system (FMS) 116 is a computerized system that may automate numerous tasks, including the management of the aircraft's flight plan based on a navigation database, Global Positioning System (GPS), and other real time navigation information. Additionally, the FMS 116 is programmed with instructions for receiving air traffic control (ATC) cleared Taxi Route, GPS/Inertial/Radio Navigation data, airport map data, runway incursion alerts from at least one data source, calculating speed and heading guidance commands, augmenting the commands for runway incursion alerts and transmitting to the flight control system 102. The FMS 116 may interact with the flight crew through a multi-function control and display unit (MCDU) having input devices, such as a keyboard and a cursor control. The FMS 116 may interface with a display 126 via an interface 116C to indicate the location of the aircraft on an airport moving map in a cockpit display showing the desired aircraft path while taxiing on ground. The FMS 116 may be coupled to receive airport map data and runway incursion from data sources through an interface 116A. These may include Electronic Flight Bag (EFB) 118 and Honeywell's Runway Awareness and Advisory System (RASS) or its more recent upgrade, the SmartRunway® system 112. A Communications Management Unit (CMU) 120 may provide ATC data; aircraft position data from GPS, Inertial and Radio Navigation aids to the FMS 116 via an interface 116F. The EFB 118 replaces paper-based references and navigation charts typically found in a heavy flight bag with electronic versions. The RAAS 112 uses GPS position data and a database to provide aural advisories that supplement flight crew awareness of aircraft position during ground operations and on approach to landing. The SmartRunway® system provides advisories and graphical alerts to the flight crew and advises them of their position during taxi, takeoff, final approach, landing, and rollout. The display system 126 provides the crew with display of situational awareness information such as the airplane attitude, altitude, speed as well as navigation information such as a moving map display. The CMU 120 also provides a data link between an aircraft and the ATC 304 through an aircraft communications addressing and reporting system/controller-pilot data link communications (ACARS/CPDLC) system.

A Traffic Collision Avoidance System (TCAS) 124 is a computerized system that is onboard aircraft and communicates with TCAS systems onboard other aircraft in the vicinity to determine potential collision situations and provide alerts to the crew to take appropriate evasive actions to avoid any imminent collisions. The TCAS 124 may be programmed with instructions, stored in a memory 124G and executed by a processor 124H, to take in Automatic Dependent Surveillance-Broadcast (ADS-B) data transmissions from ground traffic through an interface 124B. The ADS-B data transmission may be received from aircraft taxiing on ground as well as from ground vehicles. The ADS-B may then generate collision avoidance alerts on ground as well and transmit alerts to the flight control system 102 and ATC through CMU 120 via interface 124A. The TCAS 124 may also be programmed with instructions to send the ground traffic information and ground traffic collision avoidance alerts to displays via an interface 124C.

A data source selection module 122 may determine which navigational data input sources are to be used by the FMS 116. Selection may be made by the pilot manually or may be made automatically the FMS 116 to provide the flight control system 102 with the most accurate guidance commands to guide the aircraft along the taxi route the aircraft is to take and conditions and potential incursions along the way. Data sources from which the selection may be made may include: information received from the ATC 304 (FIG. 3) through the ACARS/CPDLC; values manually entered by the pilot through the FMS 116 interface; and runway incursion advisories from RAAS and airport map data used by the FMS 116. The data provided by each of these sources may be validated by the FMS 116. In addition, the pilot may manually deselect a data source if the pilot believes that its data is suspect as might occur, for example, if maintenance personnel advise the pilot that there is a problem with one of the sources. In general, data from the ATC 304 and FMS 116 database values may be the primary sources of navigational data input. Pilot-entered values may override these sources. In addition, guidance commands computed by the FMS 116 may themselves be validated by the flight control system 102.

During flight, the flight control system 102 has a mode in which it is coupled to the FMS 116. The FMS-coupled mode may be extended for on-ground navigation. In operation, the FMS 116 may compute the path that has been ordered from ATC 304 clearances received through the CMU 120 via the ACARS/CPDLC system or through manual entry by the crew. The FMS 116 may augment the cleared path information with any runway incursion advisory making use of RAAS 112 data, calculate a desired trajectory to guide the aircraft along the cleared path, and transmit the necessary guidance command to the flight control system 102. The flight control system 102 may then compute and transmit steering commands to the electric taxi controls 110. If the aircraft is not equipped with an electric taxi system 110, the flight control system 102 may compute throttle commands and nose wheel steering commands and transmit them to the auto-throttle subsystem 106, nose wheel steering subsystem 104 controls, and brake subsystem 108. In either instance, the aircraft may then be steered along the cleared path under the guidance of FMS 116 commands. Traffic collision avoidance information received from TCAS 124 which has the highest priority may be used to override the computed command to avoid any collisions.

Figure 2:
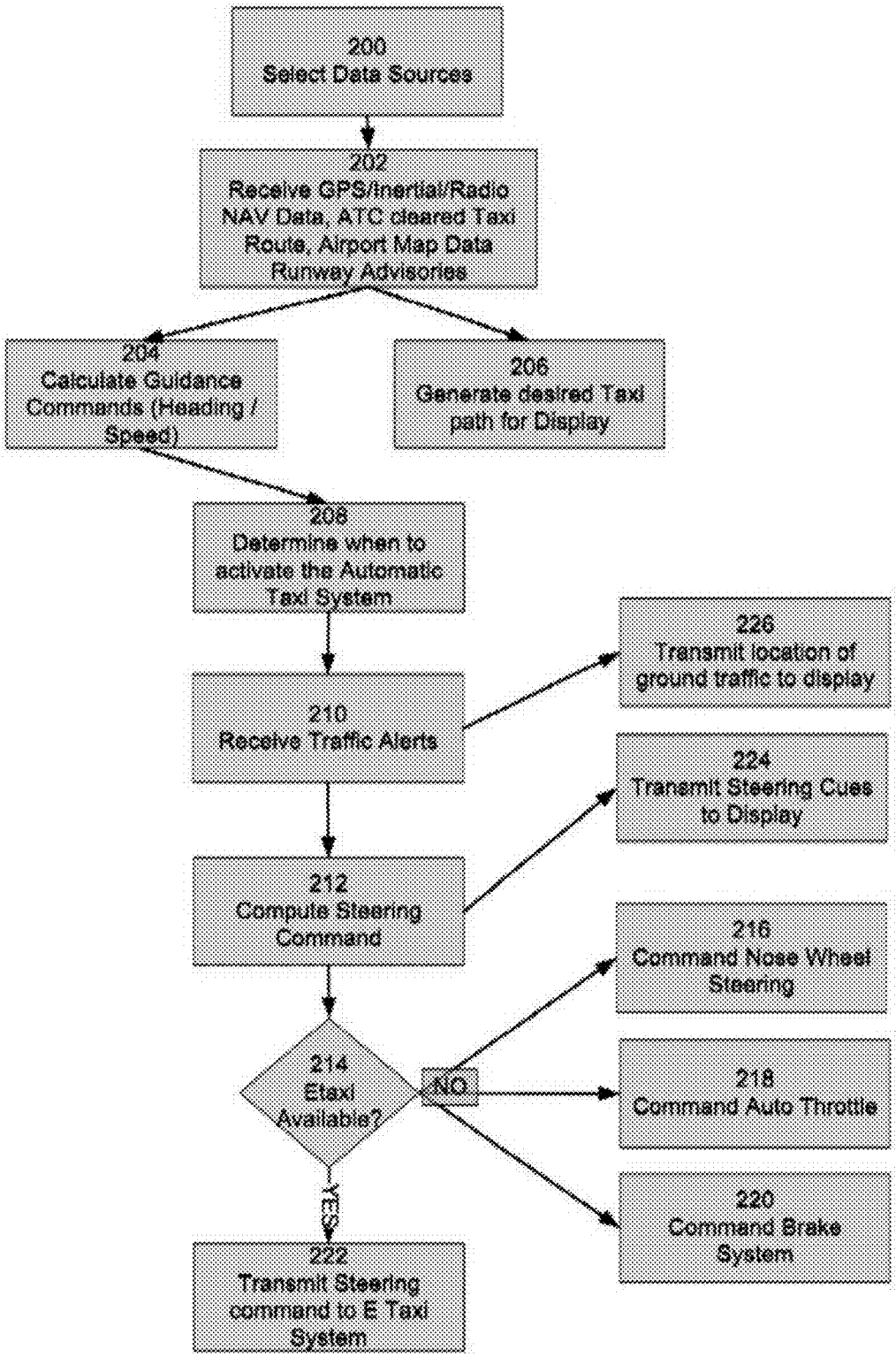
FIG. 2 is a flowchart of a method of the aircraft taxiing system of FIG. 1.

Referring to FIG. 2, after the selection of data input sources is made (step 200), either manually or automatically, an ATC cleared taxi route, Airport Map Data, aircraft position data and runway advisories are received from the selected data input source(s) 112, 118 and 120 (step 202).

In response, a processor 116D in the flight management system 116 may execute instructions stored in a memory 116E to calculate speed and heading guidance commands, augmenting the commands for runway incursion alerts and transmitting to the flight control system 102 (Step 204) and cockpit display the route the aircraft is to take from the gate to a runway or from the runway to a gate (Step 206). The aircraft's current location may also be displayed on an airport moving map on the cockpit display. The FMS 116 may compute a default target taxiing speed based upon an aircraft performance database stored in the FMS 116. The FMS 116 may also prompt the pilot to enter a recommended taxi speed that may override the default speed. The pilot may also enter into the FMS 116 any additional information, such as the runway condition, that may affect a safe taxiing speed. As part of the taxi speed computation, the FMS 116 may also use clearance data and traffic information received from the ATC 304 as well as information from an airport database, which includes an airport map with taxiways and runways. The FMS may also detect the "hold short line" while taxiing and issue a guidance command to stop the aircraft if the taxiing clearance is for holding short of the runway. The FMS 116 may generate and transmit to the aircraft display system aural and visual alerts while approaching the hold short line. The FMS 116 may compute a course deviation from the desired taxiing path and transmit the deviation to the aircraft display system along with aural and visual alerts if the course deviation exceeds a preprogrammed limit. The FMS 116 may also detect and transmit to the aircraft display system an instruction to highlight the position of parallel runways when taxiing in a section of the taxiway between parallel runways.

Based on such criteria as ground speed, weight on the wheels, and taxiway surface conditions, a determination may be made, either manually or automatically, as to when to activate the electric taxi system. At the determined time, the electric taxi system may then be activated. (step 208)

The flight control system 102 may receive traffic collision alerts for ground traffic from TCAS (Step 210)

In response to the guidance commands from FMS 116 and traffic collision avoidance alerts from TCAS 124, the processor 102H in the flight control system 102 may calculate steering commands, augment the calculated steering commands for collision avoidance (step 212), and transmit the steering commands through the electric taxi system (Step 222) if electric taxi system is installed on the aircraft or (Step 214) command the nose wheel steering, auto-throttle, and brake control subsystems 104, 106, 108, respectively, (step 216, 218, 220, respectively) to safely taxi the aircraft along the taxi route avoiding collisions and obstacles. To use the system 100 during the pre-takeoff phase of a flight from a gate to a runway, the pilot may activate the electric taxi controls 110 manually or allow the system 100 to determine when to activate the electric taxi controls 110. The pilot may also manually select which data source(s) will be input into the flight management system 116 or allow them to be chosen automatically. When the data source select module 122 is in the automatic mode, the validity of any one source may be checked against one or more other sources, leading to greater accuracy. The flight management system 116 may then receive taxiing instructions from the selected data input source(s). The taxiing instructions may include the path of the aircraft from the gate to the runway, along with any preprogrammed stops on the way.

If the electric taxi system is activated at the gate, the aircraft may push back from the gate without the use of a tug. After the aircraft has cleared the gate area, the electric taxi system 110 (if available in the aircraft) or a combination of the nose wheel steering subsystem 104, the auto-throttle subsystem 106, and the brake control subsystem 108, responding to commands from the flight control system 102, may taxi the aircraft to the designated runway at a calculated speed that is appropriate for the conditions of the weather and the taxiway. In the event that the ATC 304 issues a "hold short" order, or in the event that a selected data source detects an obstacle or other aircraft, the flight control system 102 may transmit appropriate commands to the electric taxi system (if available in the aircraft) or a combination of the nose wheel steering, auto-throttle, and brake subsystems 104, 106, 108, respectively, to stop the aircraft, thereby avoiding a potential collision.

After the aircraft reaches the designated runway, the system 100 may be deactivated and the takeoff may be performed by the pilot. During the automatic taxi out to the runway, the pilot may concentrate on various pre-flight checks.

Using the system 100 during the post-landing phase of the flight from the runway to the gate is similar. During the aircraft's approach to the destination airport, the pilot may select 122 the data source input(s) to the FMS 116. The pilot may decide to allow the system 100 to automatically activate the electric taxi system 110 at an appropriate time after landing, again based on such criteria as ground speed, weight on the wheels, and taxiway surface conditions. Alternatively, the pilot may manually activate the electric taxi system 110 manually after the aircraft has landed and completed its rollout.

When in the automatic mode, the system 100 may activate the electric taxi controls 110 when the aircraft has slowed to a predetermined speed after landing, saving fuel by allowing the main engines to be shut down. Based on information received by the selected data source(s), the flight control system 102 may then taxi the aircraft from the runway to the designated gate, responding to commands received from the ATC 304 and other sources regarding other aircraft, ground vehicles, obstacles, and weather and taxiway conditions. The pilot may also receive voice information and instructions from the ATC 304. While the system 100 may assist in moving aircraft off of the runway in any weather conditions, it may be also be useful in reducing congestion in traffic lined up for landing by moving aircraft off of the runway more quickly when weather conditions, such as visibility, are poor and aircraft would be moving more slowly if taxied manually by pilots.

When the electric taxi controls 110 are not activated or are not installed on the aircraft, the system 100 may use the auto-throttle subsystem 106 with the main engines to propel the aircraft while taxiing. The system 100 in this case may further use the nose wheel steering subsystem 104 and the brake control subsystem 108 to steer the aircraft and decelerate it respectively.

Figure 3:
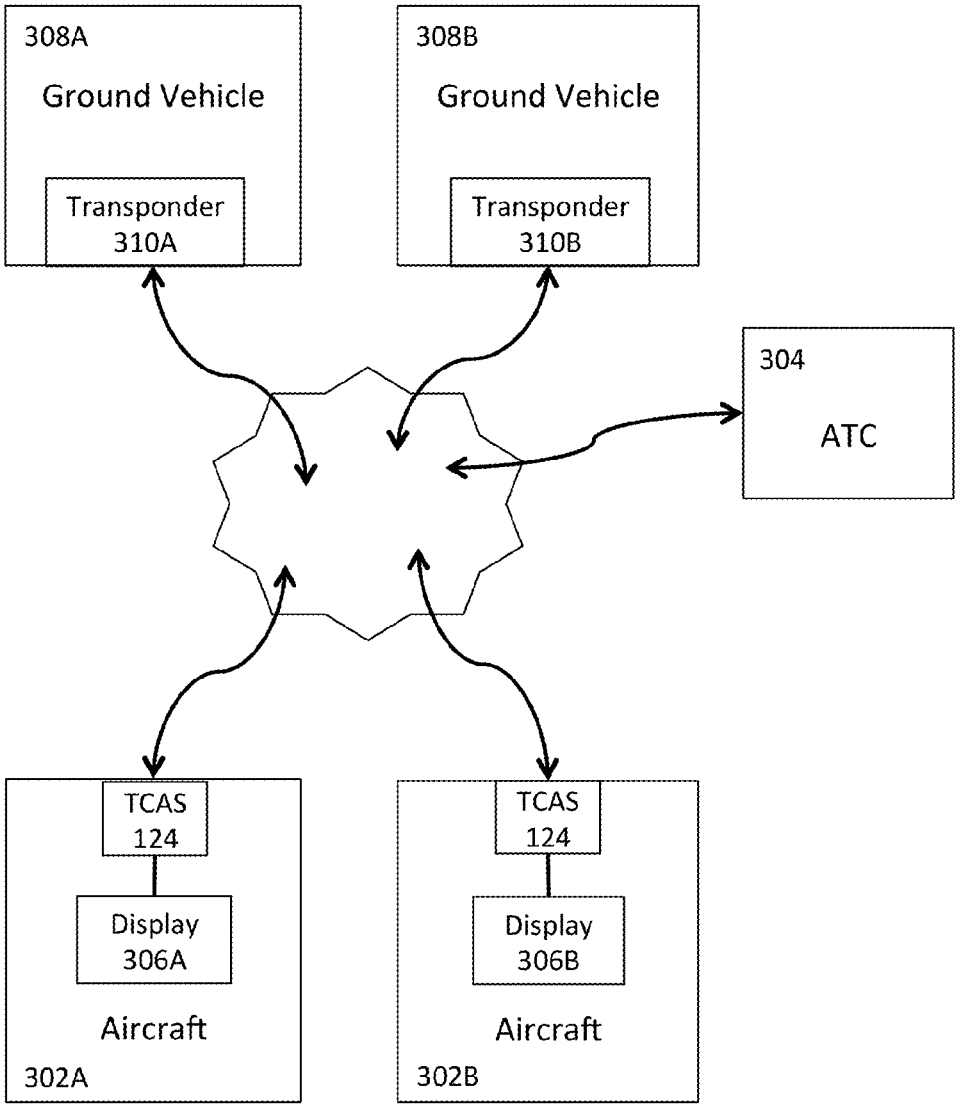
FIG. 3 is a block diagram illustrating the interaction of various aircraft and ground vehicles when the system of FIG. 1 is in use at an airport.

FIG. 3 is a block diagram illustrating the interaction of various aircraft and ground vehicles at an airport. Each aircraft 302A, 302B may be equipped with the taxiing system 100 and transmit its location to other aircraft and to the ATC 304. Cockpit electronic displays may allow each pilot to view a map of the airport, with its runways, taxiways, and gates.

The location of each aircraft 302A, 302B may be overlaid on the map in real time (step 226, FIG. 2). Additionally, airport ground vehicles 306A, 306B may be equipped with a transponder or like device 308A, 308B that broadcasts the location of the vehicle to other vehicles 306A, 306B, to the aircraft 302A, 302B, and to the ATC 304 to be displayed on cockpit maps (step 226). Further, each aircraft 302A, 302B may detect and relay any potential conflicts with ground traffic to the ATC. The ground vehicles 306A, 306B may also be equipped with receivers and electronic visual displays to allow the drivers to see the locations of aircraft and other ground vehicles. Further, the taxiing system 100 on the aircraft may automatically taxi the aircraft along the ATC cleared Taxi Route avoiding runway incursions and collisions with ground traffic (including taxiing aircrafts such as 302A, 302B as well as airport ground vehicles 308 A, 308B, 306A, 306B). As a result, the incidence of runway incursions, aircraft-aircraft collisions, aircraft-vehicle collisions, and aircraft-obstacle collisions may be reduced.

It should be understood, of course, that the foregoing relates to exemplary embodiments of the invention and that modifications may be made without departing from the spirit and scope of the invention as set forth in the following claims.

We claim:

1. An aircraft taxiing system, comprising:

a flight control system on board an aircraft and configured to automatically taxi the aircraft;

an on board electric taxi system having controls coupled to the flight control system;

a flight management system (FMS) on board the aircraft and coupled to the flight control system;

a data source selection module configured to automatically select, from among a plurality of guidance data sources, a guidance data source with the most accurate guidance commands wherein the FMS is programmed with instructions that, when executed by a first processor:

receive runway advisories from a Runway Awareness and Advisory System (RAAS);

receive taxi route data, aircraft position data, and an airport map data from the at least one guidance data source selected by the data source selection module;

couple the electric taxi system with the flight control system;

in response to the taxi route data, calculate guidance speed and heading commands;

in response to the runway advisories, augment the guidance speed and heading commands to avoid runway incursions; and transmit the speed and heading guidance commands to the flight control system;

a traffic collision avoidance system (TCAS), on board the aircraft, coupled to the flight control system, wherein the TCAS is programmed with instructions that, when executed by a second processor:

receive Automatic Dependent Surveillance-Broadcast (ADS-B) data from ground traffic including from taxiing aircraft and ground vehicles;

generate collision avoidance alerts in response to the ADS-B data; and transmit the collision avoidance alerts to the flight control system, wherein the flight control system is programmed with instructions that, when executed by a third processor:

receive guidance commands from the FMS;

receive the traffic collision avoidance alerts from the TCAS;

receive information on speed of the aircraft, taxiway surface conditions, and weight of the aircraft;

decide whether to implement the electric taxi system, said decision being based on the information including the speed of the aircraft, the taxiway surface conditions, and the weight of the aircraft; and in response to the guidance commands and collision avoidance alerts, compute steering commands and transmit the steering commands to the electric taxi system to automatically taxi the aircraft along a calculated taxi route.

2. The aircraft taxiing system of claim 1, wherein the at least one guidance data source comprises a guidance data source selected from the group consisting of RASS, Electronic Flight Bag (EFB), and Communications Management Unit (CMU).

3. The aircraft taxiing system of claim 1, wherein the TCAS is further programmed with instructions for:

receiving a location of other aircraft on the ground at the airport;

receiving a location of an airport ground vehicle; and displaying the location of the other aircraft and the ground vehicle on a cockpit map.

4. A flight management system (FMS) for an aircraft taxiing system comprising:

a first interface on board an aircraft and coupled to receive airport map data, runway advisories, air traffic control (ATC) cleared taxi route and aircraft position data from one or more of data sources;

a second interface, on board the aircraft, for receiving crew input;

a third interface on board the aircraft and coupled to transmit guidance commands to a flight control system of the aircraft, the flight control system being configured to automatically taxi the aircraft at an airport;

a fourth interface on board the aircraft and coupled to transmit a ground path to a display subsystem, wherein the FMS is programmed with instructions for:

receiving ATC cleared taxi route, GPS/Inertial/Radio Navigation data for aircraft position, airport map data, and runway advisories from at least one data source;

automatically selecting, from among a plurality of guidance data sources, a guidance data source with the most accurate guidance commands;

computing the ground path along the taxi route in response to the ATC cleared taxi route;

determining speed of the aircraft, taxiway surface conditions, and weight of the aircraft;

deciding whether to implement an electric taxi system of the aircraft, said decision being based on the speed of the aircraft, the taxiway surface conditions, and the weight of the aircraft;

calculating speed and heading guidance commands along the cleared taxi route making use of the aircraft position data;

augmenting the guidance commands for runway incursion avoidance in response to the runway advisories;

transmitting the guidance commands to the flight control system; and transmitting the cleared taxi route along with the current aircraft position to an aircraft display system.

5. The FMS of claim 4, wherein the plurality of guidance data sources include guidance data sources selected from the group consisting of Runway Awareness and Advisory System (RAAS), Electronic Flight Bag (EFB), and Communications Management Unit (CMU).

6. The FMS of claim 4, wherein the FMS is programmed with instructions for:

detecting a hold short line while taxiing;

commanding a stop via the guidance command if the taxiing clearance is for holding short of a runway;

transmitting the guidance command to the flight control;

generating aural and visual alerts while approaching the hold short line; and transmitting aural and visual alerts to the aircraft display system.

7. The FMS of claim 4, wherein the FMS is further programmed with instructions for:

computing a course deviation from a taxi path;

generating aural and visual alerts when the course deviation exceeds a preprogrammed limit; and transmitting the course deviation, aural, and visual alerts to the aircraft display system.

8. A method of automatically taxiing an aircraft at an airport comprising:

receiving runway advisories from a Runway Awareness and Advisory System (RAAS) with an on-board flight management system (FMS)

automatically selecting, from among a plurality of guidance data sources, a guidance data source with the most accurate guidance commands;

so that the most accurate guidance commands are used to guide the aircraft along the taxi route;

receiving traffic collision alerts from a traffic collision avoidance system (TCAS);

calculating steering commands and braking commands in response to the automatically selected guidance data sources, and the collision avoidance alerts; and determining speed of the aircraft, taxiway surface conditions, and weight of the aircraft;

deciding whether to implement an electric taxi system of the aircraft, said decision being based on the speed of the aircraft, the taxiway surface conditions, and the weight of the aircraft;

activating the electric taxi system; and transmitting the steering commands and braking commands to the electric taxi system to automatically taxi the aircraft along the taxi route avoiding collisions and incursions.

9. The method of claim 8, wherein:

the automatically selected guidance data source comprises at least one guidance data source selected from the group consisting of RAAS, Electronic Flight Bag (EFB), and Communications Management Unit (CMU).

10. The method of claim 8 further comprising:

receiving a location of other aircraft on the ground;

receiving a location of an airport ground vehicle; and displaying the location of the other aircraft and the ground vehicle on a cockpit map.

11. The method of claim 8 further comprising displaying in a cockpit display the taxi route on an airport map and indicating the current position of the aircraft on the taxiing route display.

12. The method of claim 8 further comprising of automatically detecting a hold short line while taxiing and coming to a stop if the taxiing includes holding short of the runway.

13. The method of claim 12, further comprising highlighting the hold short line on an airport map on a cockpit display and generating aural and visual alerts while the aircraft is approaching the hold short line.

14. The method of claim 13, further comprising;

displaying the taxi route on the airport map;

indicating the current position of the aircraft on the cockpit display;

generating aural and visual alerts while the aircraft is approaching the hold short line; and highlighting the position of parallel runways on the cockpit display when taxiing in a section of the taxiway between parallel runways.

15. The method of claim 8 further comprising automatically sending collision avoidance alerts with ground traffic to the ATC.

16. The method of claim 8 further comprising indicating a course deviation from the taxi route and generating aural and visual alerts when the course deviation from the taxi route exceeds predetermined programmable limits.

* * * * *